United States Patent [19]

Lamy

[11] 4,051,686

[45] Oct. 4, 1977

[54] PLATFORMS RESTING UPON THE BED OF A BODY OF WATER

[75] Inventor: Jacques Edouard Jean Lamy, Fontenay-aux-Roses, France

[73] Assignee: C. G. Doris, Paris, France

[21] Appl. No.: 594,568

[22] Filed: July 9, 1975

Related U.S. Application Data

[63] Continuation-in-part of Ser. No. 521,075, Nov. 5, 1974.

[30] Foreign Application Priority Data

July 12, 1974 France ..... 74.24310

[51] Int. Cl.[2] ..... E02B 17/00

[52] U.S. Cl. ..... 61/86

[58] Field of Search ..... 61/46.5, 46, 69 R, 72.3, 61/72.5, 86–104; 166/.5, .6; 277/30, 34.3; 214/1 PA

[56] References Cited

U.S. PATENT DOCUMENTS

| | | | |
|---|---|---|---|
| 2,442,622 | 6/1948 | Starr | 277/30 |
| 2,775,869 | 1/1957 | Pointer | 277/34.3 X |
| 2,815,966 | 12/1957 | House | 277/34.3 |
| 2,921,442 | 1/1960 | Laborde et al. | 61/46.5 |
| 2,937,006 | 5/1960 | Thayer | 61/46.5 X |
| 3,145,539 | 8/1964 | Estes et al. | 61/46.5 |
| 3,146,458 | 8/1964 | Estes et al. | 61/46.5 |
| 3,163,147 | 12/1964 | Collipp | 61/46.5 X |
| 3,436,920 | 4/1969 | Blenkarn et al. | 61/46.5 X |
| 3,486,343 | 12/1969 | Gibson et al. | 61/46.5 |
| 3,525,388 | 8/1970 | McClintock | 166/.5 |
| 3,913,335 | 10/1975 | Heien | 61/46.5 |

*Primary Examiner*—Dennis L. Taylor
*Attorney, Agent, or Firm*—Wigman & Cohen

[57] ABSTRACT

A platform device comprising an underwater structure equipped wth a base resting upon the bed of a body of water, and a bridge carried by said structure above the surface of the body of water, characterized in that the underwater structure comprises, in the base or in proximity thereof, a plurality of chambers which can be kept dry and can be isolated from one another, said chambers being equipped wth access means and being suitable to receive devices or apparatus connected to a network of piping systems placed upon the bed of the sea.

7 Claims, 15 Drawing Figures

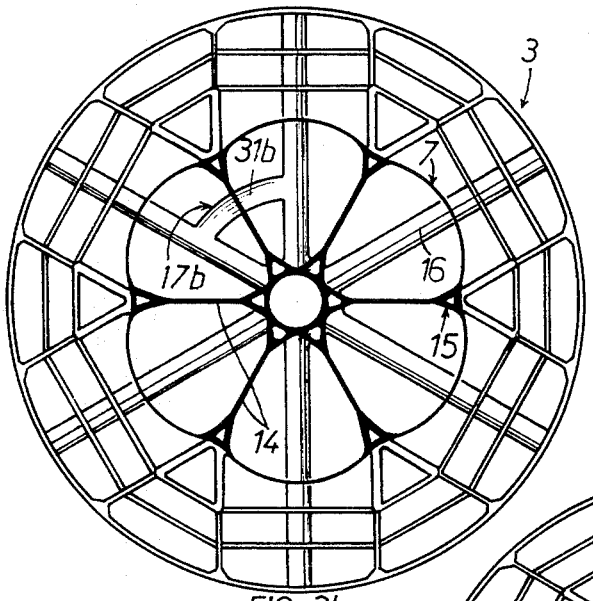
FIG.: 2b
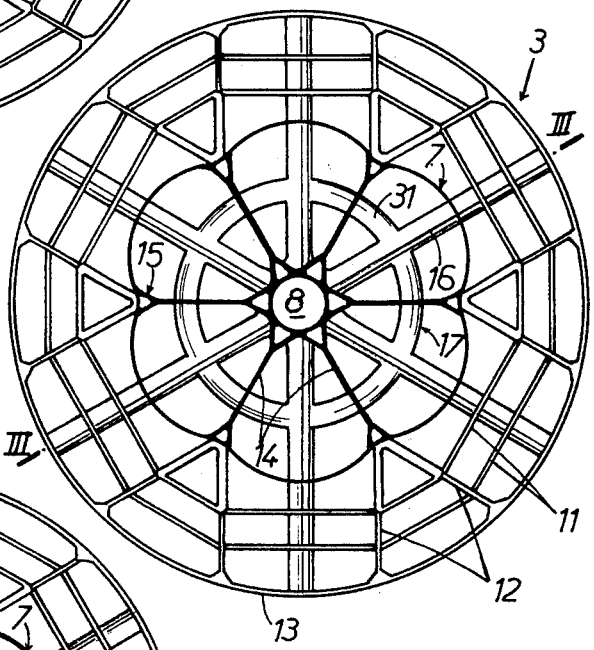
FIG.: 2
FIG.: 2a
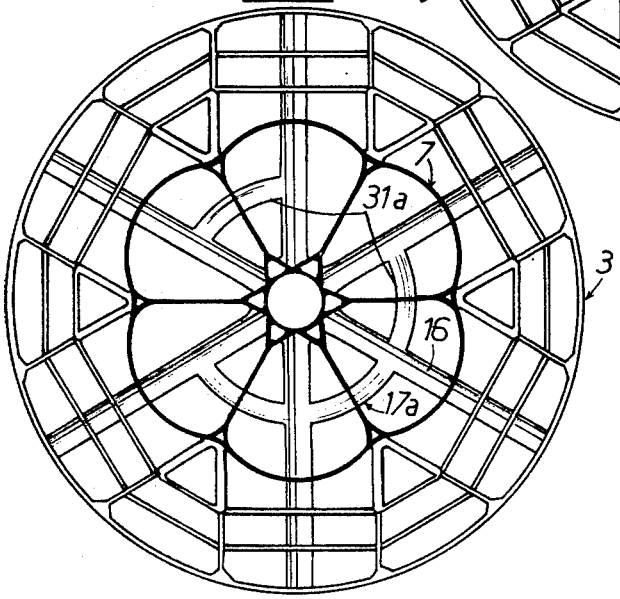

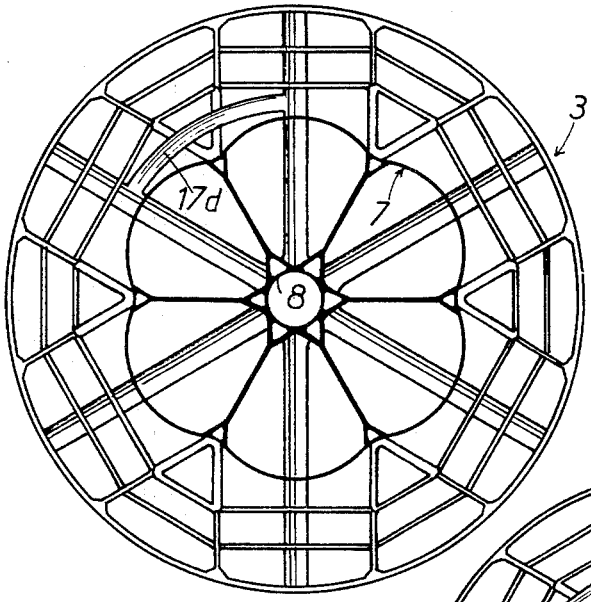
FIG.: 5a
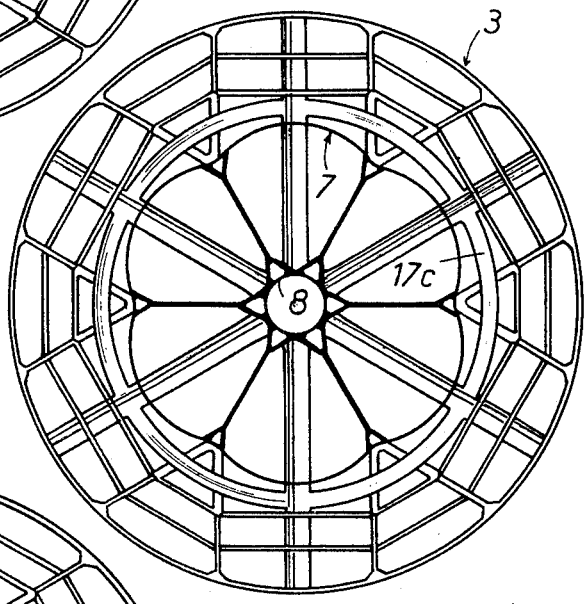
FIG.: 5
FIG.: 5b
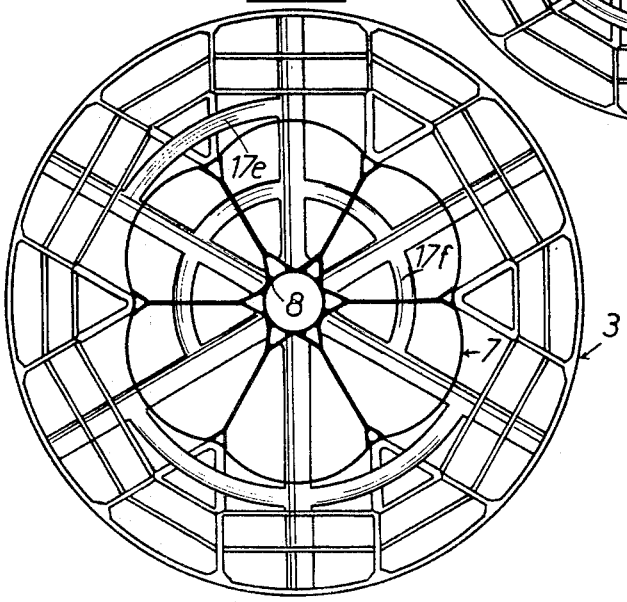

PLATFORMS RESTING UPON THE BED OF A BODY OF WATER

This is a continuation-in-part of my co-pending U.S. Patent Application Ser. No. 521,075 filed Nov. 5, 1974.

The present invention relates to platforms supported above the surface of a body of water, by a structure equipped with a base resting upon the bed of said body of water, and relates more particularly to platforms arranged or designed to be arranged in the sea of offshore locations in order to receive drilling installations and installations for exploiting petroleum or natural gas wells.

These installations comprise a network of piping systems resting upon the bed of the sea and connected to a certain number of linking and control devices such as valves or metering instrumentation, as well as to apparatus which carries out certain kinds of operations, for example water or gas separators or recompression units. At the current state of the art, these devices and said apparatus are arranged upon the bridges of platforms supported above the surface of the water.

The object of the present invention is an improvement which makes it possible to avoid having to install these devices and apparatus on the bridges of the platforms, this having the dual advantage of freeing the bridges for other installations and of economising on the upgoing and downgoing piping systems between the bridges and the bed of the body of water.

The platform in accordance with the invention is supported by an underwater structure comprising, in the base thereof or in its proximity, a plurality of chambers which can be kept dry and isolated from one another, which are equipped with access means and designed to receive devices or apparatus connected to a network of piping systems placed upon the sea-bed.

The access means comprise, preferentially, one or more shafts integral with the structure, which can be kept dry and link the chambers to a bridge of the platform. However, one or more of the chambers can also be equipped with an access airlock for divers or with an opening to which a diving bell can be fitted.

In one embodiment, the chambers comprise a network of tunnels disposed radially in the base of the structure and connected to a central shaft which terminates at a bridge of the platform, and one or more tunnels disposed circumferentially of the base or above same. These latter tunnels can form one or more circles, one or more polygons, one or more circular arcs or one or more portions of polygons, about the shaft.

The description which now follows and is given in relation to the attached drawings illustrated by way of non-limitative examples, will indicate how the invention can be put into effect all features contained both in the drawings and in the specification falling, self-evidently, within the scope of said invention.

FIG. 2 is a horizontal sectional view at the level of the line II—II of FIG. 1.

FIGS. 2*a* and 2*b* are views similar to that of FIG. 2, illustrating variant embodiments.

Figure 3:
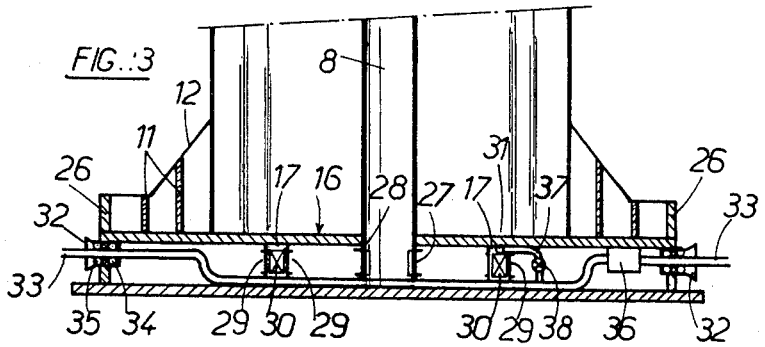

FIG. 3 is a vertical sectional view on the line III—III of FIG. 2.

Figure 4:
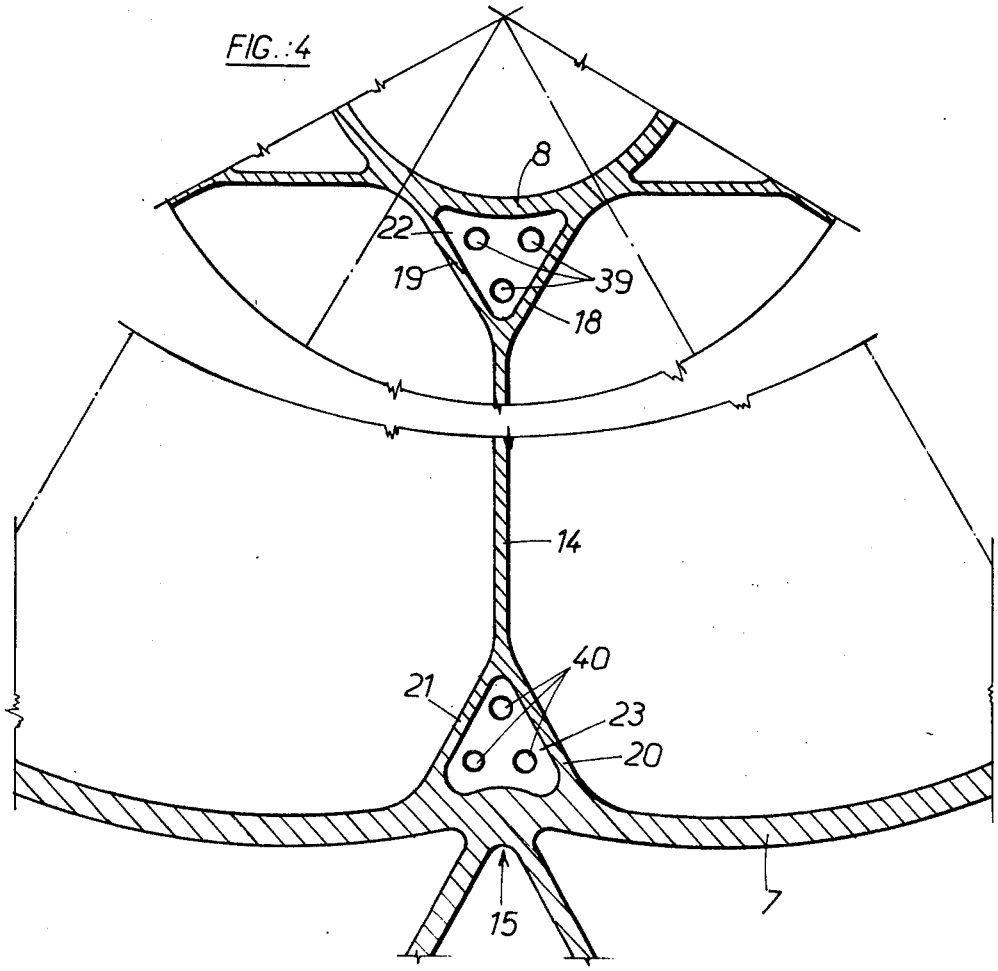

FIG. 4 is an enlarged view of a detail of FIG. 2.

FIG. 5 is a view similar to that of FIG. 2, showing a different arrangement of the circumferential tunnel.

FIGS. 5*a* and 5*b* are views similar to FIG. 5, illustrating variant embodiments.

Figure 1:
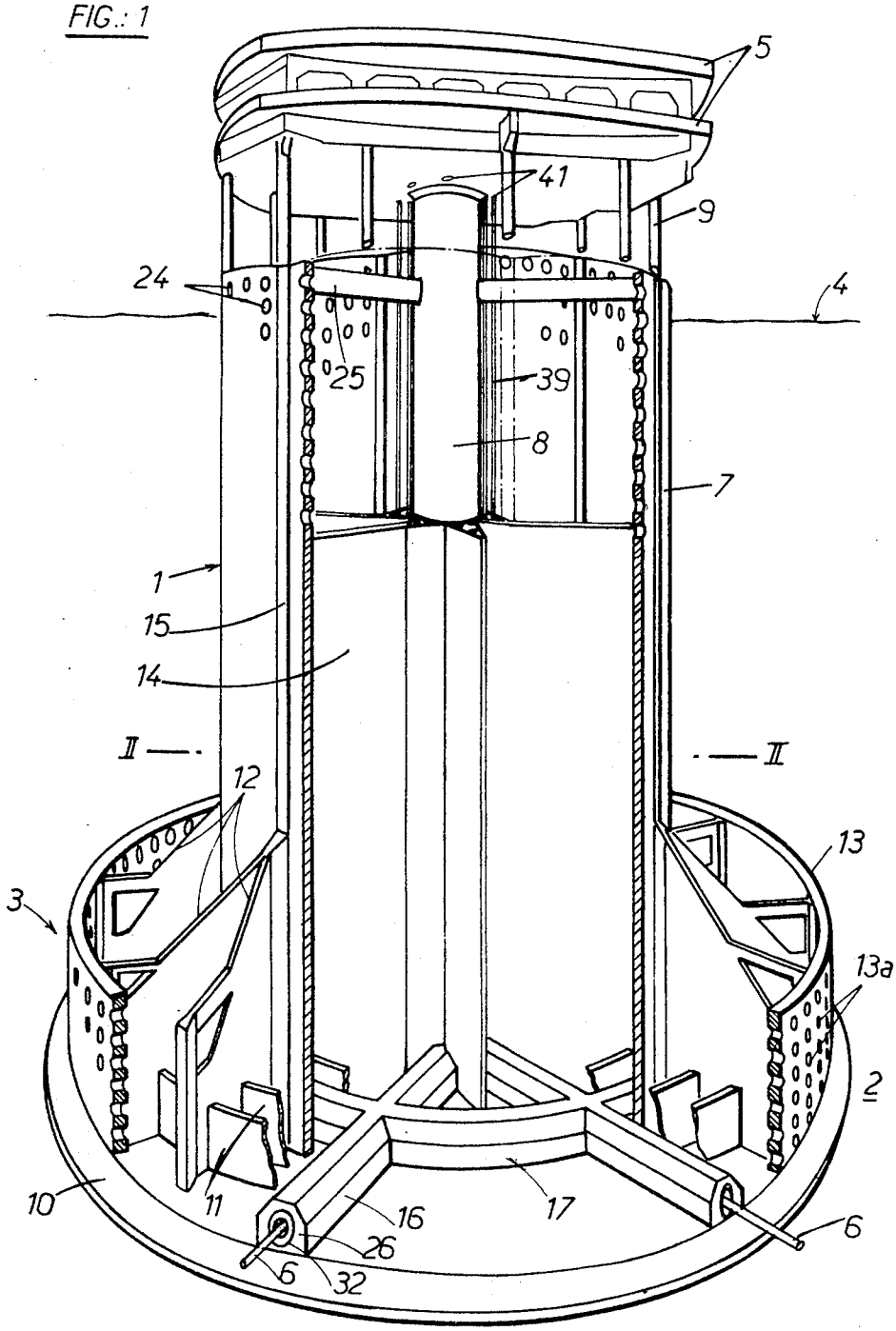
FIG. 1 is a general perspective view with partial cut-aways, of a platform structure in accordance with the invention, comprising a central shaft and a network of tunnels disposed radially and circumferentially.
Figure 6:
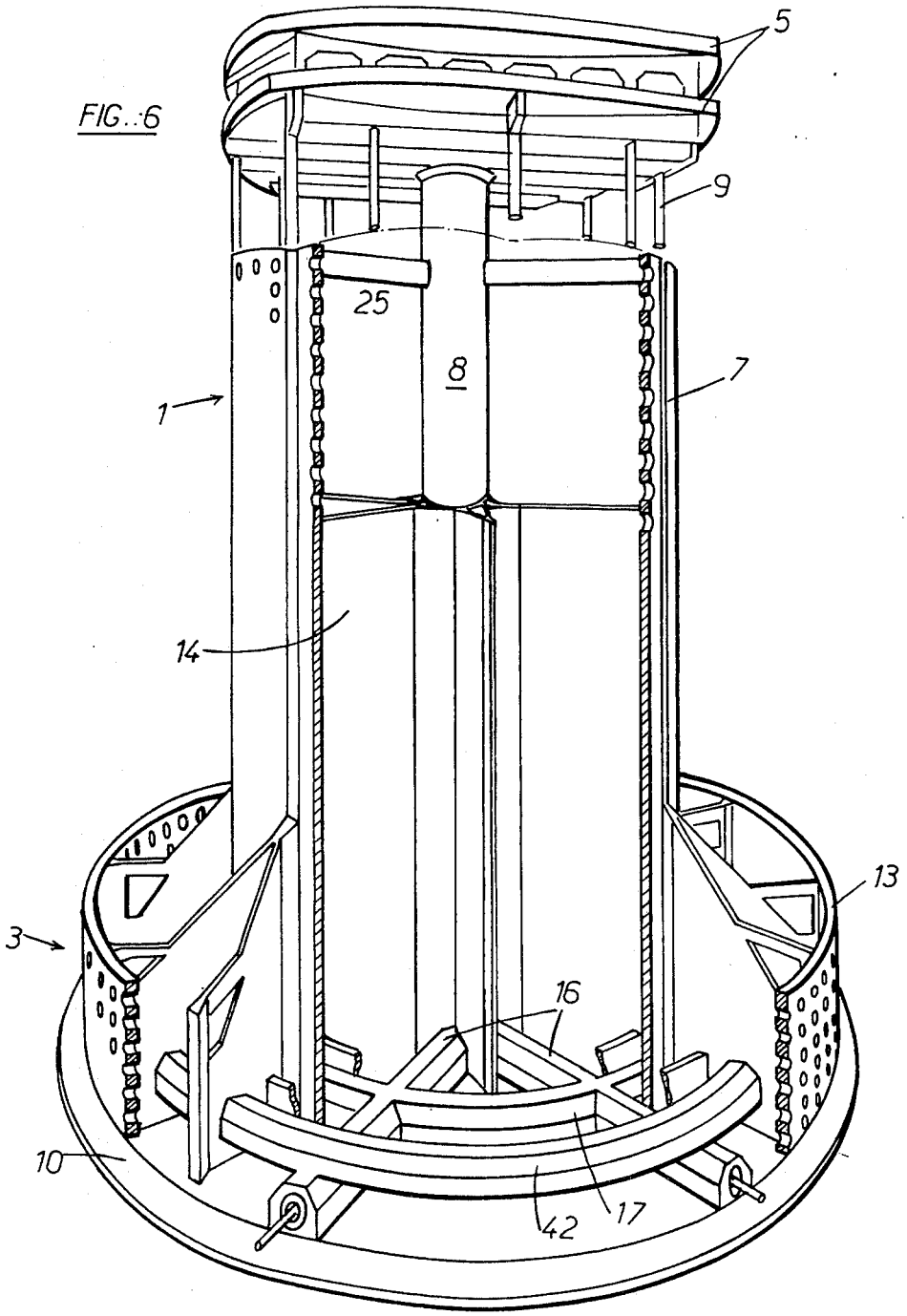

FIG. 6 is a view similar to that of FIG. 1. showing another disposition of the tunnels.

Figure 7:
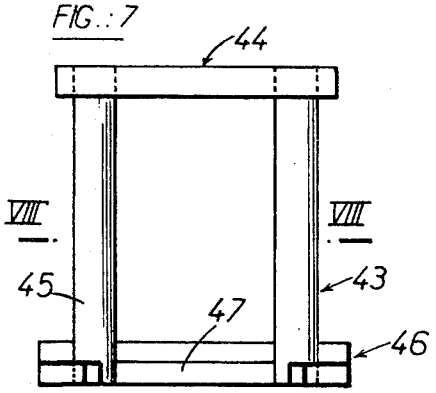
Figure 8:
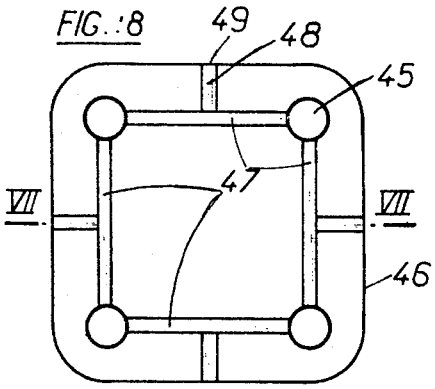

FIG. 7 illustrates on a smaller scale another embodiment of a platform structure in accordance with the invention, seen in vertical section on the line VII—VII of FIG. 8.

FIG. 8 is a sectional view on the line VIII—VIII of FIG. 7.

Figure 9:
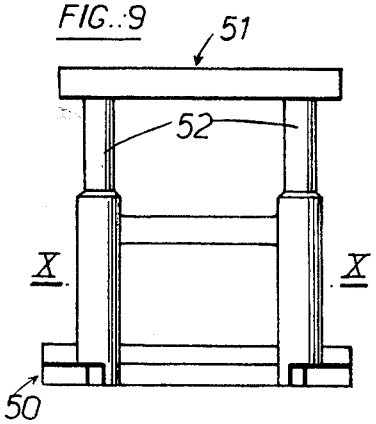
Figure 10:
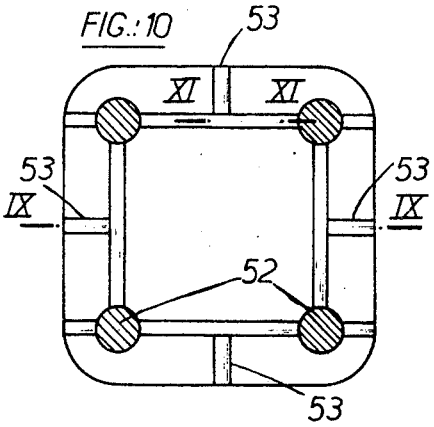

FIG. 9 is a view similar to that of FIG. 7, showing another embodiment again, in section on the line IX—IX of FIG. 10.

FIG. 10 is a view in section on the line X—X, of FIG. 9.

Figure 11:
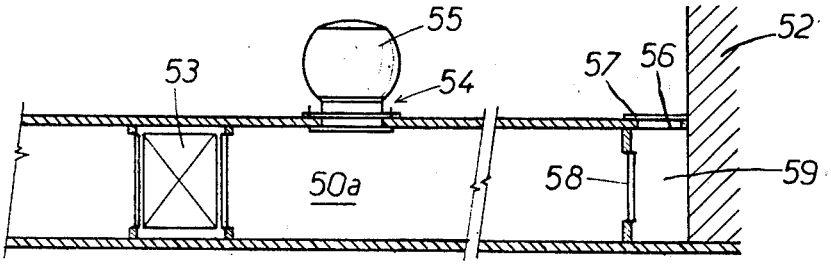

FIG. 11 is a view in partial section, on a larger scale and on the line XI—XI of FIG. 10, showing access by airlock and access by diving bell.

The platform shown in FIGS. 1 and 2 comprises a structure 1 designed to rest upon the sea-bed 2 through its base 3, in order to support above the surface 4, two bridges 5 carrying petroleum-extraction installations which have not been shown and which are connected to a network of piping systems arranged on the sea-bed 2, partly visible at 6. The structure 1 comprises a cylindrical body 7, for example of lobed hexagonal shape, as shown, encastre in the base 3 and ascending above the level of the surface 4 of the sea, a central hollow barrel forming a shaft 8 which also rises from the base 3 and extends up to the bridges 5, and pillars 9 which rest upon the periphery of the cylindrical body and co-operate with the central barrel 8 in order to support the bridges 5.

The base 3 comprises:

at the bottom, a slab 10 which serves to transmit to the sea-bed 2 the vertical loads imposed by the platform, said slab being stiffened by beams 11 which rest on buttresses 12;

at its periphery, a circular perforated wall 13 which serves to stiffen the slab 10 and prevent undermining of the sea-bed 2 around the structure, by reason of the provision of said perforations, in the manner described in U.S. Pat. No. 3,878,684;

at its centre, the base of the lobed wall of the cylindrical body 7, diaphragms 14 which link the intersections 15 between the lobes of the wall 7, with the central hollow barrel 8;

radial tunnels 16 and a circular tunnel 17, attached to the slab 10 and described in more detail hereinafter.

As FIG. 1 shows particularly clearly, the buttresses 12 upon which the beam 11 rest, link the intersections 15 between the lobes 7, to the perforated wall 13, thus producing complete encastre fixing of the lobed cylindrical body 7 in the base. FIGS. 2 and 4 show in particular how the attachment of the diaphragms 14 to the central barrel 8 on the one hand, and to the intersections 15 between the lobes of the wall 7, on the other, is effected by connecting webs 18–19 and 20–21 between which cavities 22 and 23 are formed whose purpose will be described hereinafter. The lobed wall 7 is perforated by a plurality of holes 24 distributed over its surface from its top down to a level a little below the level of the lowest tides. The diaphragms 14 are interrupted at this level and the top of the lobed wall 7 is attached to the barrel 8 by means 25 arranged star-fashion and connected to the intersections 15 between the lobes, and to the barrel 8, like the diaphragms 14, by devices which form cavities in line with the cavities 22 and 23. The pillars 9 located in line with the cavities 23, are hollow.

The tunnels 16 extend radially from the hollow barrel 8 and terminate flush with the external face of the perforated wall 13 where they are closed off in water-tight fashion by walls 26. These tunnels 16 pass through the beams 11 and the lobed wall 7. They are intersected by the circular tunnel 17 which is located between the barrel 8 and the lobed wall 7 and which passes through the diaphragms 14. The tunnels 16 terminate in the hollow barrel 8 in water-tight doors 27 formed in water-tight partitions 28 (see FIG. 3). At the points where the circular tunnel 17 opens into the tunnels 16, again water-tight partitions 29 are provided containing water-tight doors 30. Thus, each radial tunnel 16 can be isolated from the hollow barrel 8 and each arcuate portion such as that 31 (FIG. 2) of the circular tunnel 17, can be isolated in relation to the two adjacent radial tunnels.

Each of the walls 26 closing off the external ends of the radial tunnels 16 contains a water-tight lead-through across the wall 32, making it possible to pass across an element 33 of the network 6 of piping arrangements. The device 32 is essentially constituted by a sleeve closed off externally by a pressure-differential operated panel (not shown) and equipped with two inflatable seals 34, 35. After having flooded the tunnel into which the piping 33 is to be introduced, the panel, which has not been shown, is removed (for example by divers), since it is no longer applied against the sleeve 32 due to the fact that the pressure inside the tunnel is the same as that outside, whereupon the piping 33 is introduced through the sleeve 32 and the seals 34 and 35 are inflated by means of a compressed air source located on the bridges 5. The tunnel is then emptied and epoxy resin is injected between the two seals 34 and 35 in order to create a permanent seal.

In the embodiment illustrated, a flowmeter 36 is connected to that branch of the piping 33 located in the tunnel disposed at the right-hand side of the drawing, and this piping 33 passes through the watertight partition such as 28, separating the hollow barrel 8 from said tunnel and from that disposed in extension thereof, and links up again with the network of piping arrangements 6 arranged on the sea-bed, by passing through a second lead-through 32. A branch 37, controlled by a valve 38, passes through the water-tight partition 29 and enters the circular tunnel section 31, Of course, the hollow barrel 8 can be used to carry the piping 33, or a branch thereof, up to the bridges 5. However, the hollow barrel 8 is likely to be full of other equipment and at the time of construction of the platform piping systems 39, 40 (FIG. 4) are installed which terminate in the tunnels, enter the cavities 22 and 23 and end at the bridges 5 after having passed through the hollow pillars 9 or through orifices illustrated at 41 in FIG. 1. To utilise one of these piping systems 39 and 40, it is merely necessary to connect it to a piping system such as that shown at 33 passing through the tunnel where it terminates.

FIG. 2*a* illustrates a variant embodiment in which the circular tunnel 17*a* is incomplete and simply comprises two circular, non-contiguous arcuate portions 31*a*. FIG. 2*b* illustrates another variant embodiment in which only a single circular arcuate portion 31*b* is used. It goes without saying, of course, that in other embodiments, a certain number of radial tunnels could be omitted and that the circular tunnel could comprise an arbitrary number of portions extending over different arcs.

FIG. 5 illustrates an arrangement which differs from that of FIGS. 1 and 2 simply in terms of the fact that the circular tunnel 17*c* is located around the lobed cylinder 7. FIG. 5*a* illustrates an arrangement in which the circular tunnel located outside the lobed cylinder 7, is reduced to a single circular arcuate portion 17*d*, and FIG. 5*b* illustrates an arrangement in which the circular arcuate tunnel portions 17*e* are disposed outside the lobed wall 7 and circular arcuate portions 17*f* are disposed between said lobed wall and the central barrel 8.

FIG. 6 illustrates an embodiment in which, in addition to the circular tunnel 17 of FIG. 1, a second circular tunnel 42 is located above the radial tunnels 16 and communicates with same through watertight trapdoors, not shown, formed in their ceilings. It is within the scope of the present invention to provide several circular tunnels located at different levels and communicating or otherwise, with the radial tunnels, and for that matter also to discard the radial tunnels altogether.

FIGS. 7 and 8 illustrate an embodiment in which no radial tunnels are provided. The structure 43 which supports the platform 44 is constituted by four hollow pillars 45 attached to a base 46 designed to rest upon the sea-bed. In this base, four tunnels 47 are formed which link the bases of the hollow pillars 45 and communicate with tunnel elements 48 the extremities of which are closed off by walls 49 similar to the walls 26 of FIG. 1, through which piping systems communicating with the network of pipes 6, can be passed into the tunnels.

FIGS. 9 to 11 illustrate an embodiment in which no communication is provided between the chambers located in the base 50 of a platform, and the bridge 51 thereof. In this embodiment, the bridge 51 is carried by hollow pillars 52 the feet of which are attached to the base 50. In the latter, chambers 50*a* are formed communicating with the exterior through tunnel elements 53 similar to tunnel elements 48. As FIG. 11 shows, the ceiling of each of the chambers 50*a* is provided with an opening 54 normally closed off by a panel which has not been shown and to which there can be attached, by means of bolts, a dividing bell 55, and with another opening 56 closed off by a panel 57 and enabling a diver to enter the chamber 50*a* through a water-tight door 58 which forms an airlock 59 in association with the panel 57.

It goes without saying that the embodiments illustrated are purely examples and are open to modification, in particular by the substitution of equivalent techniques, without in so doing departing from the scope of the invention.

1. In combination with an external piping system resting submerged upon a seabed for conveying a useful fluid between at least two spaced, submerged locations on the seabed, an offshore platform comprising a base structure resting upon the seabed and having means for supporting a bridge structure emergent from the surface of the sea when the base structure is disposed upon the seabed, said base structure including submerged, mutually isolated work chambers located in said base structure and bounded by at least two watertight walls, said work chambers being maintained dry in their undersea environment, an internal piping system housed in said work chambers, means sealed across said watertight walls for interconnecting said submerged external piping system with said internal piping system at a point interposed between said two spaced locations, and including fluid handling means for pumping said useful fluid from that portion of said external piping system located between said offshore platform and one of said spaced locations to that portion of said external piping system located between said offshore platform and another of said spaced locations.

2. The combination as claimed in claim 1, wherein said dry work chambers comprise watertight bulkheads isolating said chambers from each other, and said internal piping system sealingly crosses said watertight bulkheads.

3. The combination as claimed in claim 2, wherein said dry work chambers comprise a network of tunnels along which sections of said internal piping system extend, said watertight bulkheads being fitted with watertight doors interconnecting said tunnels.

4. The combination as claimed in claim 3, wherein said network of tunnels comprises radiating tunnels ending with a watertight terminal transverse wall, said piping system interconnecting means being sealed across said terminal transverse wall.

5. The combination as claimed in claim 1, wherein said piping system interconnecting means comprises a pipe section crossing a watertight wall of a dry work chamber, and inflatable sealing means in said wall around said pipe section.

6. The combination as claimed in claim 5, wherein said inflatable sealing means comprises two inflatable seal rings spaced from each other along said pipe section to bound therewith an annular space around said pipe section.

7. The combination as claimed in claim 6, further comprising sealing material disposed in said annular space to form a permanent seal at the crossing of said watertight wall by said pipe section.

* * * * *